US005843871A

United States Patent [19]

Beik et al.

[11] Patent Number: 5,843,871

[45] Date of Patent: Dec. 1, 1998

[54] ELECTROMAGNETIC FILTER HAVING A TRANSMISSION LINE DISPOSED IN A COVER OF THE FILTER HOUSING

[75] Inventors: Mostafa A. Beik, Arlington Heights, Ill.; H. Clark Bell, Chatsworth, Calif.; Amr Abdelmonem, Arlington Heights, Ill.

[73] Assignee: Illinois Superconductor Corporation, Mt. Prospect, Ill.

[21] Appl. No.: 556,371

[22] Filed: Nov. 13, 1995

[51] Int. Cl.[6] ..... H01P 1/201; H01B 12/02

[52] U.S. Cl. ..... 505/210; 505/700; 505/866; 333/202; 333/219; 333/230; 333/235; 333/99 S

[58] Field of Search ..... 333/219.1, 219, 333/230, 235, 203, 202, 202 DR, 202 HC, 99 S; 505/210, 700, 866

[56] References Cited

U.S. PATENT DOCUMENTS

| | | | |
|---|---|---|---|
| 3,525,953 | 8/1970 | Halverson | 333/209 |
| 3,876,963 | 4/1975 | Graham | 333/202 |
| 4,028,652 | 6/1977 | Wakino et al. | 333/209 |
| 4,184,123 | 1/1980 | Grill et al. | 330/56 |
| 4,206,428 | 6/1980 | Kaegebein | 333/207 |
| 4,241,322 | 12/1980 | Johnson et al. | 333/202 |
| 4,446,429 | 5/1984 | Froncisz et al. | 333/219 X |
| 4,551,694 | 11/1985 | Biehl et al. | 333/24 R |
| 4,725,779 | 2/1988 | Hyde et al. | 333/219 |
| 4,896,125 | 1/1990 | Blair, Jr. et al. | 333/219.1 |
| 4,933,652 | 6/1990 | Gaukel | 333/225 |
| 5,051,714 | 9/1991 | Bentivenga et al. | 333/227 |
| 5,191,304 | 3/1993 | Jachowski | 333/202 |
| 5,340,797 | 8/1994 | Hodge et al. | 505/780 X |
| 5,373,270 | 12/1994 | Blair et al. | 333/202 |
| 5,608,363 | 3/1997 | Cameron et al. | 333/202 |
| 5,616,540 | 4/1997 | Lithgow et al. | 333/202 X |
| 5,714,919 | 2/1998 | Satoh et al. | 333/219.1 X |

FOREIGN PATENT DOCUMENTS

| | | | |
|---|---|---|---|
| 150203 | 9/1982 | Japan | 333/219.1 |
| 309501 | 12/1989 | Japan | 333/202 DR |

OTHER PUBLICATIONS

Llopis, O. et al. "Microwave Characterization of High Tc Superconductors with a Dielectric Resonator"; *Journal of Less Common Metals* ; No. 164 & 165; 1990; pp. 1248–1250.

Hardy and Whitehead, "Split–ring resonator for use in magnetic resonance from 200–2000 MHz," *Rev. Sci. Instrum.*, 52(2) (Feb. 1981) pp. 213–216.

Delayen Dick and Mercereau, "Test of a β≅0.1 Superconducting Split Ring Resonator*," *IEEE Transactions on Magnetics*, vol. Mag–17, No. 1, (Jan. 1981) pp. 939–942.

Bell, Jr., "Narrow Bandstop Filters," *IEEE Transactions on Microwave Theory and Techniques*, vol. 39, No. 12 (Dec. 1991) pp. 2188–2191.

Bell, Jr., "Canonical Asymmetric Coupled–Resonator Filters," *IEEE Transactions on Microwave Theory and Techniques*, vol. MTT–30, No. 9 (Sep. 1982) pp. 1335–1340.

(List continued on next page.)

*Primary Examiner*—Benny T. Lee
*Attorney, Agent, or Firm*—Marshall, O'Toole, Gerstein, Murray & Borun

[57] ABSTRACT

An electromagnetic filter has a unitary filter body defining a number of cavities. A cover for the filter body has several resonators attached to it which are located in the cavities when the cover is attached to the filter body. The cover has a recess into which a transmission line is placed. Passageways through the cover connect the transmission line with coupling mechanisms mounted on the cover adjacent the resonators. The resonators have a generally toroidal shape and the coupling mechanisms are shaped to provide the desired coupling between the transmission line and the resonators. An adjustable capacitor attached to the coupling loop has a passageway through its housing to eliminate moisture from the capacitor. The resonator and cavities may be tuned by use of a tuning mechanism which is also designed to minimize moisture which might prevent movement of the tuner during tuning.

8 Claims, 11 Drawing Sheets

OTHER PUBLICATIONS

Bell, Jr., "Transformed–Variable Synthesis of Narrow–Bandpass Filters," *IEEE Transactions on Circiuts and Systems*, vol. CAS–26, No. 6 (Jun. 1979) pp. 389–394.

Bell, Jr., "Bandwidth Adjustment in Iterative Approximation Procedures," *IEEE Transactions on Circuits and Systems*, vol. CAS–25, No. 12 (Dec. 1978) pp. 951–954.

Jezek, Tran and Ishii, "Strip–ring resonator makes harmonics–rich oscillator," *Microwaves & RF* (Jun. 1984) pp. 132–134.

Brill et al., "Antenna Filters for a Military Radio System," Bell Laboratories Record, vol. 36, No. 4, pp. 142–145, Apr. 1958.

ELECTROMAGNETIC FILTER HAVING A TRANSMISSION LINE DISPOSED IN A COVER OF THE FILTER HOUSING

BACKGROUND OF THE INVENTION

The present invention relates generally to electromagnetic filters and more particularly to features of such filters which improve filtering characteristics at the cryogenic temperatures necessary for proper operation of superconducting components of those filters.

BACKGROUND ART

In designing electromagnetic filters, it is desirable to reduce the surface resistance of various components in the filter, such as resonators, in order to increase the quality factor of those resonators and thereby decrease the insertion loss of the filter. Designs using superconductors have been tested and shown to have greatly improved filtering characteristics over non-superconducting filter designs. While their increased filtering performance is desirable, superconductors have the drawback of requiring maintenance of an environment around the superconductor below the critical temperature of the superconducting material. For instance, superconductors made from yttrium barium cupric oxides generally must be cooled to 92° K. (−181° C.). The cooling puts stresses on the filter materials and may change the critical positioning of various components and harm filter performance. The greater the number of components, the larger the chances of an undesirable change in positioning resulting from cooling.

Along with the low temperature necessary for operation of superconducting materials, it has also proven desirable to control other aspects of the environment around the components. Moisture located in cavities containing superconductors will freeze into ice crystals. Ice may have undesirable electromagnetic properties by, for instance, providing a thermally and/or electrically conductive path between structures which were insulated from each other at room temperature. In addition, the expansion of water, which accompanies the formation of ice, can force precisely positioned components out of their locations. Thus it may be desirable to pressurize filters containing superconductors with an inert gas or to subject the cavities to vacuum to remove all gaseous material including moisture from them. However, components that are conventionally used in room temperature filters may not be designed for pressurization or evacuation, and therefore may not be fully pressurized with inert gas or completely purged, leading to trapped moisture or gases in those components. The desirability of pressurizing or evacuating a filter housing may make conventional room temperature filter housings unsuitable for use with superconductors. Filter housings must accommodate lines for inputting to and outputting signals from the filter. Those lines are generally insulated from the housing themselves, thereby creating difficulties in insuring a gas-tight seal at the housing around the lines. Such difficulties are exacerbated by conventional filter housing designs which often have numerous openings through a housing.

Many filters using superconductors involve the coating of a substrate with the superconducting material to create a resonator. Resonator shapes which were used in non-superconducting filters may not be desirable in superconducting filters because they are difficult to coat. In addition, the electromagnetic properties of the superconductors have led to shapes of resonators which would not have been desirable at room temperature. Therefore, many new shapes of superconducting resonators have been proposed. Unfortunately, the coupling mechanisms which transmit signals to or from resonators have previously been designed with room temperature resonators in mind and may not have desirable electromagnetic properties for use with the new shapes of superconducting resonators. Prior art coupling mechanisms may also be undesirable in a superconducting environment because they are sensitive to temperature change or are difficult to adjust when the filter is placed in a cryogenic environment, such as a closed cryo-refrigerator or a liquid nitrogen bath.

SUMMARY OF THE INVENTION

In accordance with one aspect of the present invention, a coupling mechanism for coupling energy to or from a resonator has a loop with a first end and a second end. A first arm on the loop is attached to the first end and a second arm on the loop is attached to the second end. A U-shaped portion on the loop connects the first arm to the second arm and the first arm is generally parallel to the second arm.

The first end of the loop may be connected to a signal source and the second end of the loop may be coupled to ground.

The second end may be coupled to ground through an adjustable capacitor which has a first electrically conductive side and a second electrically conductive side. The coupling mechanism may be located in a cavity surrounded by a housing. The adjustable capacitor is mounted to the housing and is adjustable from outside the housing. An insulated housing may be located between the first side of the capacitor and the second side of the capacitor. A cavity formed in the capacitor contains a first plate and a second plate, where the first plate is in electrical contact with the first side of the capacitor and the second plate is in electrical contact with the second side of the capacitor. The first plate may be moved with respect to the second plate to adjust the capacitance of the capacitor. The capacitor has an opening connecting the cavity to the environment outside the capacitor so that moisture and/or gas can be removed through the opening.

The first end of the coupling mechanism may be curved away from the second end and the second end of the loop may be curved away from the first end.

A resonator, used with the coupling mechanism, may be curved where the curve lies in a first plane. The first arm of the loop and the second arm of the loop lie in a second plane which is generally parallel to the first plane. The resonator may be a toroid having a circular inner edge and a circular outer edge. The second arm of the loop may be spaced from the resonator and extends from past the outer edge toward the inner edge along a path which is generally tangent to the inner edge. The first arm of the loop may be spaced from the resonator and generally tangent to the outer edge of the resonator. The resonator may be a halfwave resonator. The resonator has a midpoint and the first end of the loop may be adjacent to the midpoint of the resonator.

In accordance with another aspect of the present invention, an electromagnetic filter has a housing with a plurality of cavities. The filter has a signal input connection and a signal output connection. A cover has a first side and a second side where the cover is attached to the housing so that the first side of the cover faces the cavities. A plurality of resonators are attached at the first side of the cover and located in the cavities when the cover is attached to the housing.

The filter is located in an atmosphere having a temperature significantly below ambient temperature. The resonators may be made of a superconductor and the cavities may be evacuated of gases. Electromagnetic coupling mechanisms may be mounted on the first side of the cover and located adjacent the resonators where the coupling mechanisms are adjustable from the second side of the cover.

In accordance with another aspect of the present invention, an electromagnetic filter may have a housing containing a plurality of resonators. A transmission line having an input and an output is connected to a plurality of coupling mechanisms, each coupling mechanism located adjacent to a resonator. The housing has a body and a cover where the cover has a main portion and a lid. The main portion and the lid form a chamber in which the transmission line is located. The main portion of the lid has openings through which conductors pass to connect the transmission line to the coupling mechanism. The resonators may be attached to the cover.

In accordance with still another aspect of the present invention, an adjustable capacitor has a first electrically conductive side and a second electrically conductive side. An insulated housing is located between the first side of the capacitor and the second side of the capacitor. A cavity is formed in the capacitor and contains a first plate and a second plate, where the first plate is in electrical contact with the first side and the second plate is in electrical contact with the second side. The first plate is movable with respect to the second plate to adjust the capacitance of the capacitor. An opening in the capacitor connects the cavity to the environment around the capacitor to remove moisture and/or gas from the cavity.

The capacitor may have a threaded sleeve and a threaded post which may be rotated with respect to the sleeve to move the first plate. The opening may evacuate gases in the chamber that enter the chamber between the sleeve and the post. The opening may also fill the chamber with gas, and gas may leave the chamber between the sleeve and the post. The environment of the capacitor may be maintained below zero degrees celsius.

In accordance with yet another aspect of the present invention, a tuner for tuning an electromagnetic resonator has a conductor and a tuner body with a first end and a second end, where the first end can be attached to the conductor. A recess is formed in the tuner body adjacent the second end. A cap has a first end and a second end where the first end of the cap can be attached to the tuner body when the cap is inserted into the tuner body recess. The second end of the cap has structure for engaging a device which applies force to the cap. A passageway through the cap connects the second end of the cap to the first end of the cap.

The tuner may be used in combination with a housing having a cavity in at least one wall of the housing. A resonator is mounted on the housing in the housing cavity and the wall has a threaded bore. The tuner body has a threaded outer surface and the tuner body is rotatable by rotating the cap. Rotation of the tuner body moves the conductor closer to or farther from the resonator.

The threaded bore may have a threading bushing. The resonator may have a superconductor and the cavity may be maintained at a temperature below zero degrees celsius. The conductor may be a disc.

In accordance with another aspect of the present invention, an electromagnetic filter may have a housing with a base and a cover where the base and cover define a plurality of cavities. A plurality of resonators are mounted on the cover and located in the cavities. A transmission line with an input and an output is contained in and electrically insulated from any conductor of the lid. A plurality of coupling mechanisms are mounted to the cover where each coupling mechanism is electrically connected to the transmission line and located adjacent to a resonator.

Other features and advantages are inherent in the filter and filter components claimed and disclosed or will become apparent to those skilled in the art from the following detailed description in conjunction with the accompanying drawing.

DETAILED DESCRIPTION OF THE PREFERRED EMBODIMENT

Figure 1:
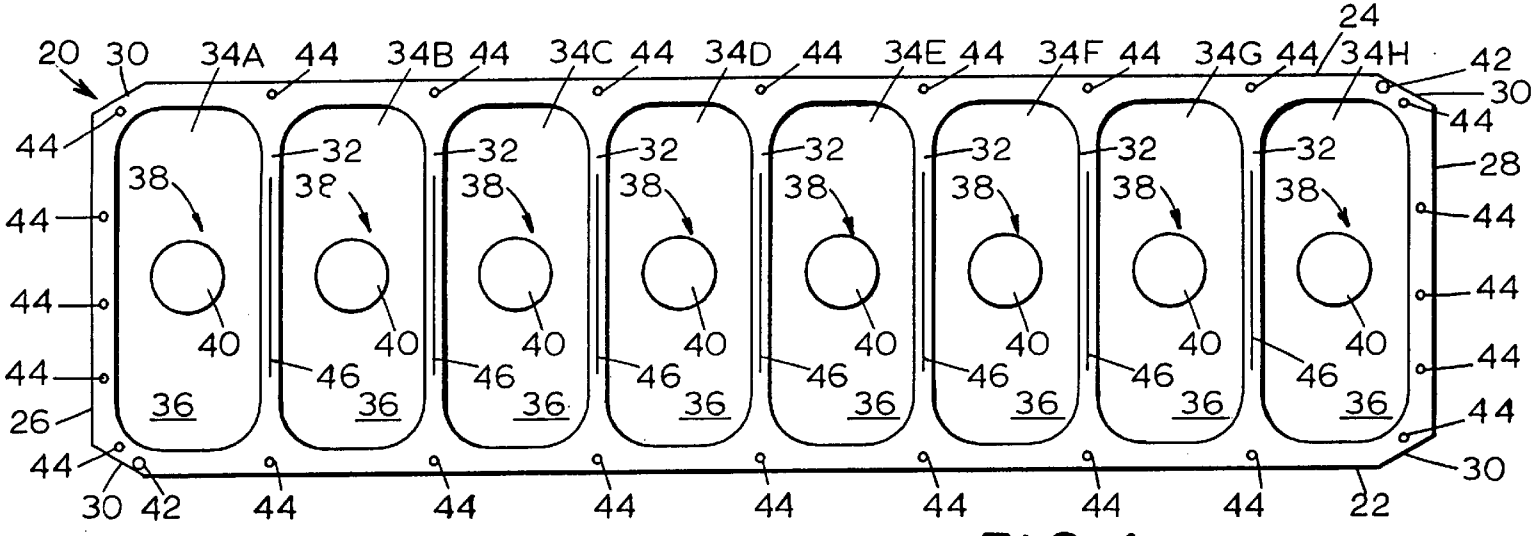
FIG. 1 is a top-plan view of a housing body of a filter of the present invention.
Figure 2:
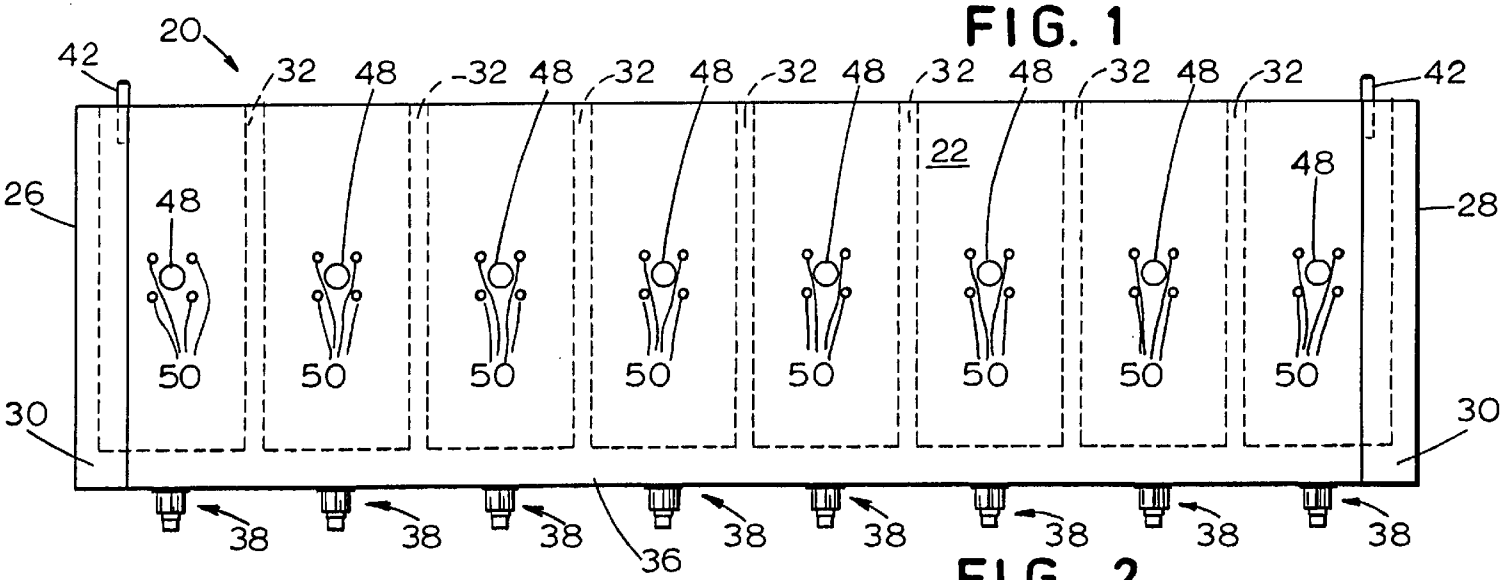
FIG. 2 is a side-elevational view of the housing body of FIG. 1.
Figure 3:
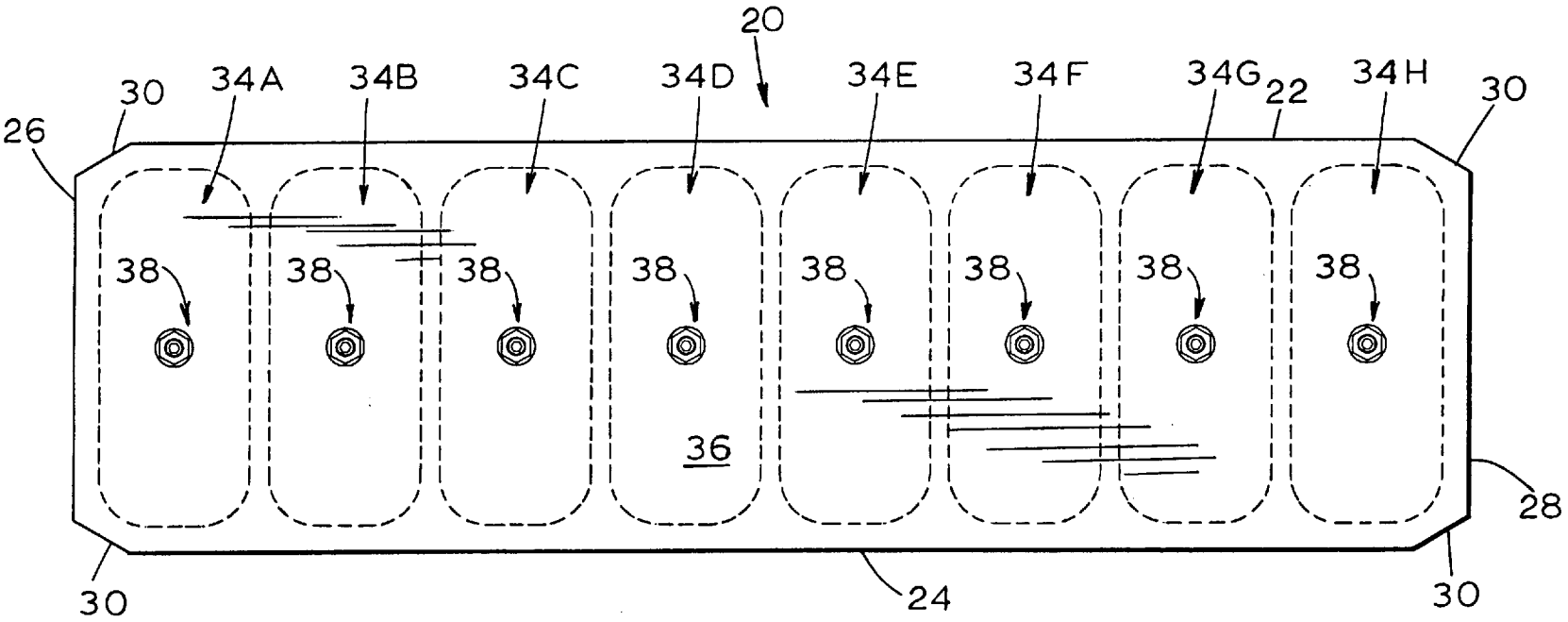
FIG. 3 is a bottom view of the housing body of FIG. 1.
Figure 4:
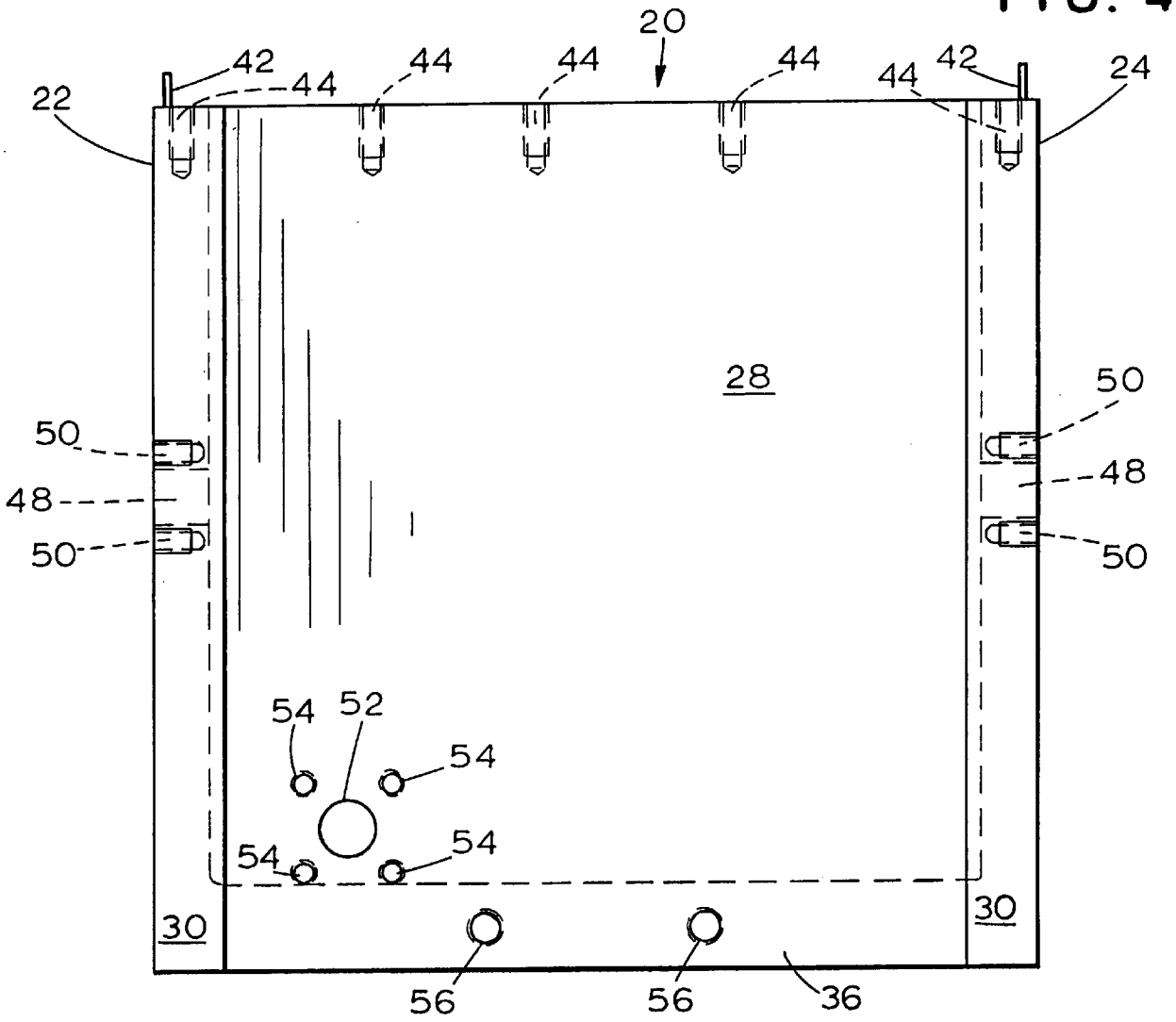
FIG. 4 is an end-elevational view of the housing body of FIG. 1.

Referring initially to FIGS. 1–4, an electromagnetic filter of the present invention has a filter body indicated generally at 20. The filter body 20 has a front wall 22 and a back wall 24 (FIGS. 1, 3 and 4) and end wall 26 (FIGS. 1, 2 and 3) and end wall 28. The filter body 20 is shaped near the end walls 26 and 28 to form four beveled walls 30. A series of inner walls 32 (FIG. 1) form partitions connecting the front wall 22 to the back wall 24 to create cavities 34A, 34B, 34C, 34D, 34E, 34F, 34G and 34H (FIGS. 1–3). In addition to being bounded by the front wall 22, the back wall 24 and the inner walls 32, the cavities 34A–34H are bounded by a bottom wall 36. Passing through bottom wall 36 are tuners 38 (FIGS. 1–3), including tuning discs 40 (FIG. 1) located in the cavities 34A–34H. A portion of tuners 38 extends outside of the wall 36 (FIGS. 2 and 3), each of which is used for adjusting the distances that the tuning discs 40 extend into the cavities 36. Details and operation of the tuners 38 are discussed more fully below in connection with FIGS. 13 and 14.

On the top of the filter body 20 on opposite corners are two alignment pins 42 (FIGS. 1, 2 and 4), which are used to align the cover discussed below (FIGS. 5, 8 and 9) when that cover is secured to the filter body 20. Several threaded openings 44 (FIGS. 1 and 4) are located along the top of the filter body 20 in the front wall 22, the back wall 24 and the end walls 26 and 28 into which screws are placed to secure the cover to the filter body 20. Threaded openings (omitted for clarity) may also be placed along the inner walls 32. A groove 46 (FIG. 1) is located on each of the inner walls 32 which are adapted for receiving indium solder. It may be desirable to place three parallel grooves (not depicted) on the inner walls 32. The outer grooves would be filled with indium solder and the center groove would be larger and left unfilled. The indium solder provides a seal between the inner walls 32 and a cover in order to prevent coupling of electromagnetic energy between adjacent cavities 34A–34H. Indium solder may also be used on the front wall 22, the back wall 24, and the end walls 26 and 28. The filter body 20 may be made of a metal such as copper or aluminum plated with silver, particularly in areas facing the cavities 34A–34H.

Located on the front wall 22 are passageways 48 (FIG. 2), each passageway 48 surrounded by four threaded openings 50 (FIG. 2). The openings 48 may be used for insertion of probes to measure various electromagnetic properties inside the cavities 34A–34H. Such probes may be useful when manufacturing a filter of the present invention or may be used during its operation. A probe would be inserted into the opening 48 and secured in place using threaded openings 50. It may be desirable to counter bore a circular area around the passageways 48 to insure proper positioning of a probe. If probes are not used or are only used during assembly of the filter, the passageways 48 can be covered with a plug or plate secured to the front wall 22 by use of the threaded openings 50. The passageways 48 in the front wall 22 may also be placed in the back wall 24.

A passageway 52 (FIG. 4) may be placed in the end wall 28. The passageway 52 is surrounded by four threaded openings 54 (FIG. 4) which can be used for securing a probe similar to those which could be used in connection with the passageways 48. The passageway 52 might also be used to pressurize the filter cavities 34A–34H with an inert gas such as helium which may be useful if the filter body 20 is immersed in liquid nitrogen or similar fluid in order to maintain the filter at a cryogenic temperature. The passageway 52 could also be used to couple a signal into or out of the cavity 34 H. Larger threaded openings 56 may be used to attach a handle (not depicted) to aid in moving the filter body 20. The end wall 26 may also be provided with passageways and threaded openings similar to those shown for the end wall 28.

Figure 5:
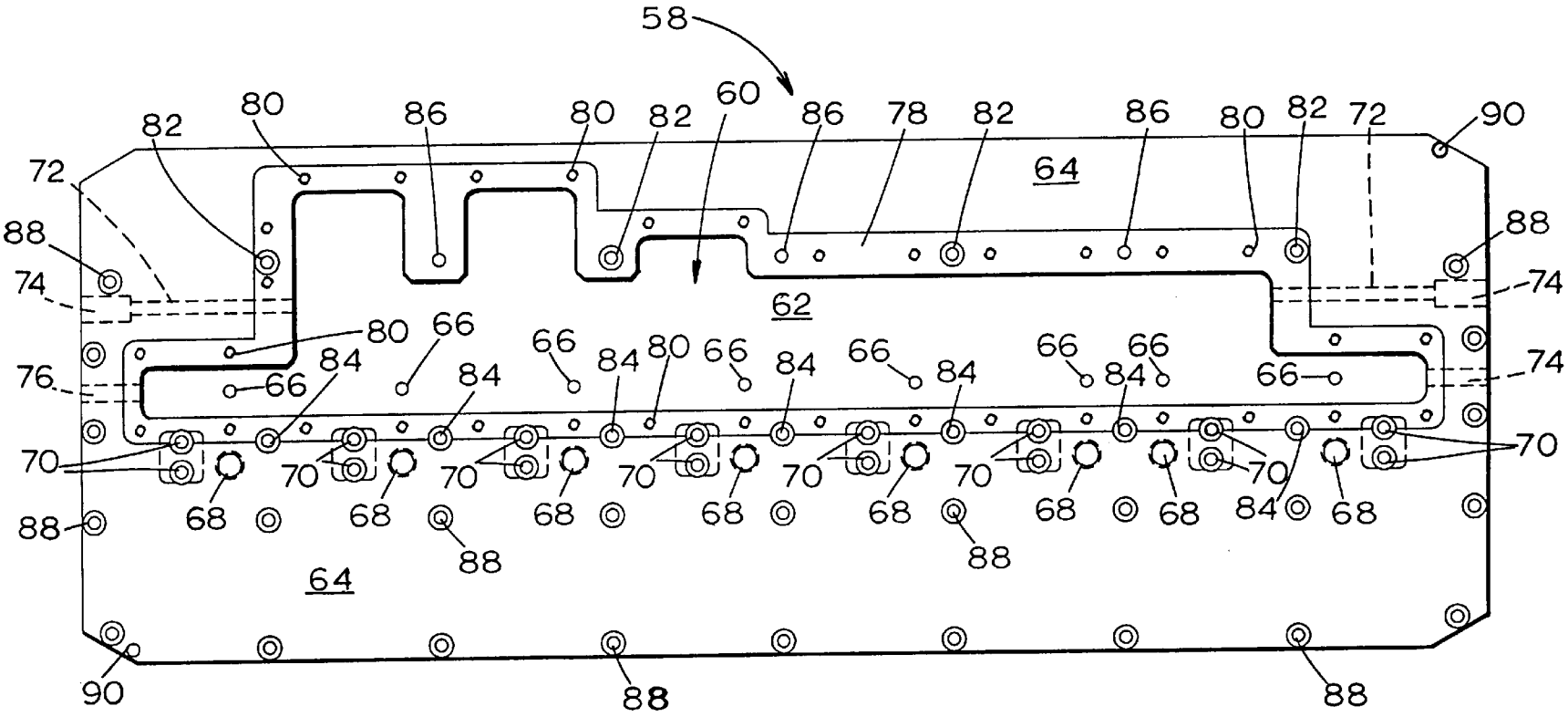
FIG. 5 is a top-plan view of a housing cover of a filter of the present invention.

Referring now to FIG. 5, a housing cover 58 has a recess 60 which is adapted to receive a transmission line as discussed below in connection with FIG. 8. The recess 60 has a back wall 62 which is set in from a top surface 64 of the housing cover 58. Passing through the housing cover 58 on the back wall 62 are eight passageways 66, one for each cavity 34A–34H. Passing through the housing cover 58 on the top surface 64 are eight threaded shafts 68. The passageways 66 and threaded shaft 68 are used to couple energy from a transmission line to the cavities 34A–34H. Adjacent each shaft 68 is a set of mounting bores 70 which are used to attach resonators to the bottom surface (the opposite side of top surface 64 shown in FIG. 5). The mounting bores 70 may have an inset flange around them adjacent the top surface 64 in order to permit the heads of screws inserted into the mounting bores 70 to be flush with or below the top surface 64.

At each end of the housing cover 58 is a shaft 72 having an expanded portion 74. The shafts 72 connect the recess 62 to a source of gas in order to fill it and other parts of the filter with that gas such as helium. The shaft 72 may also be connected to a vacuum system in order to evacuate the recess 62 and other parts of the filter of gases. Adjacent the expanded portion 74 are tubes 76 which permit the connection of devices (not depicted) for inputting or outputting signals to the filter.

Between the recess 60 and the top surface 64 of the housing cover 58 is a shelf 78. Located around the shelf 78 are numerous threaded openings 80 which are used to secure the lid (shown in FIG. 7) to the cover 58. Several bores 82 are also located on the shelf 78 and are provided with inset flanges to allow the heads of bolts passing through the bores 82 to be flush with or below the surface of shelf 78. Several bores 84 are located along the edge between the top surface 64 and the shelf 78. The bores 84 are provided with a recessed flange so that the heads of the bolts may be at or below the top surface 64. The bores 84 are used to secure the cover 58 to the filter body 20. Several passageways 86 are also located on the shelf 78 and pass through the cover 58. The passageways 68 are used to secure the lid of FIG. 7 through the housing cover 58 to the filter body 20. Numerous bores 88 are located on the top surface 64 and pass through the housing cover 58 to secure it to the filter body 20. Some bores 88 and threaded openings 80 have been omitted or left unnumbered in FIG. 5 for clarity. At opposite corners of the housing cover 58 are alignment holes 90 which are used in connection with alignment pins 42 to align the housing cover 58 with the filter body 20.

Figure 6:
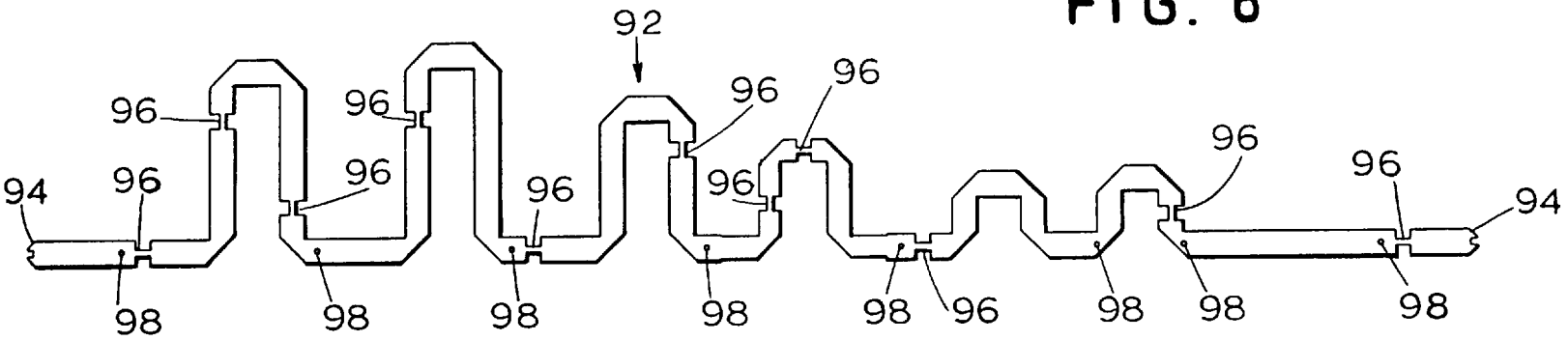
FIG. 6 is a top-plan view of a transmission line of a filter of the present invention.

A transmission line 92 shown in FIG. 6 has ends 94 which are connected to the input and/or output of the filter. The transmission line 92 has several notched areas 96 which are used to support the transmission line 92 in an electrically insulated fashion. Eight holes 98 pass through the transmission line 92 which may be made of a metal such as copper. Transmission lines may be used in band-stop type filters, where signals in the stop band are reflected by the cavities. The distance between the holes 98, which are used to couple signals to the cavities, is critical and will depend on the filtering characteristics for a particular application and filter design, as is well known to those skilled in the art.

Figure 7:
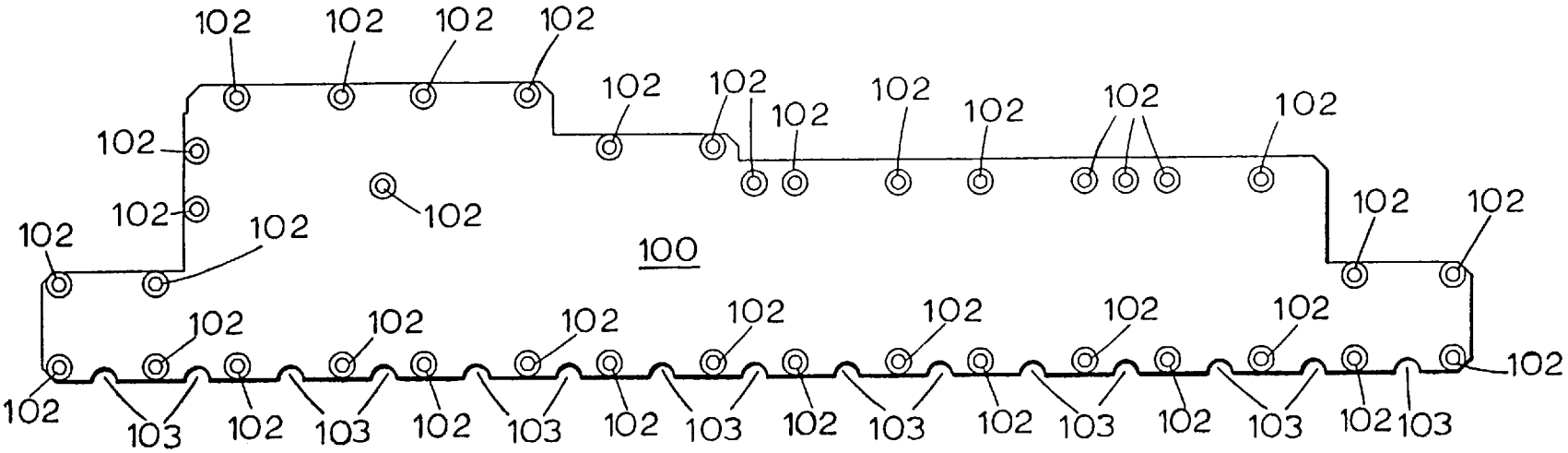
FIG. 7 is a top-plan view of a lid for the filter cover of FIG. 5.

Referring now to FIG. 7, a lid 100 is shaped to cover the recessed area 62 and the shelf 78 of the housing cover 58 depicted in FIG. 5. The lid 100 has numerous bores 102, each of which has an annular recess so that the head of a bolt placed into a bore 102 will be flush with or below the top of the lid 100. A number of semi-circular cutouts 103 are located along one edge of the lid 100. The cutouts 103 are necessary to accommodate bolts placed in the bores 70 and the bores 84 in the housing cover 58 shown in FIG. 5. The cover 58 may be made of metal such as copper or silver plated aluminum.

Figure 8:
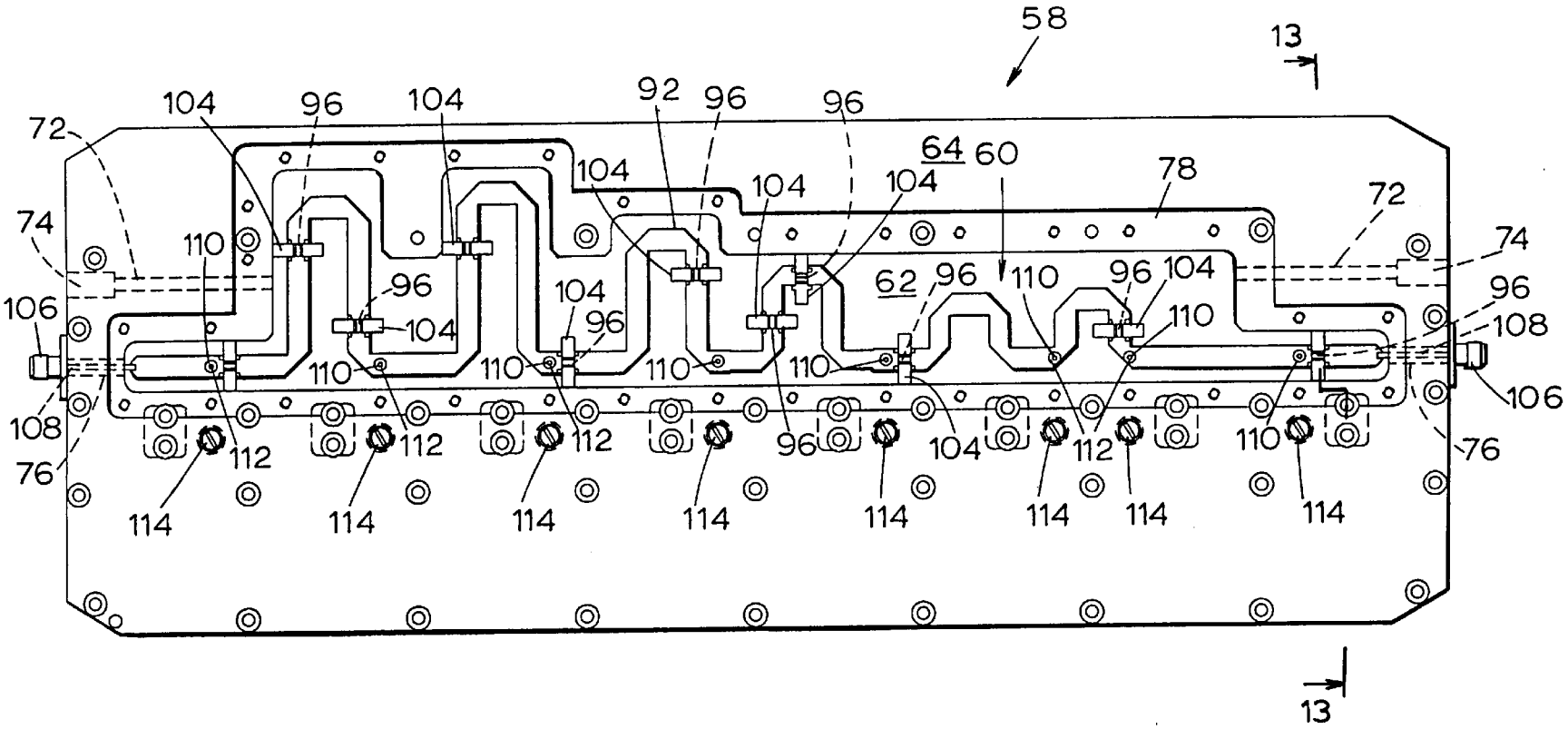
FIG. 8 is a top-plan view of the cover of FIG. 5 including a transmission line.

Referring now to FIG. 8, the housing cover 58 has the transmission line 92 in place in the recess 60. The transmission line 92 is held in place in the cavity 60 by use of spacers 104. The spacers 104 are made of a non-electrically conductive material so that they insulate the transmission line 92 from the housing cover 58 which may be made of metal such as copper or silver plated aluminum. Each spacer 104 has two parts in order to sandwich the notched area 96 of the transmission line 92 (FIG. 13) and hold it in place. At each end of the housing cover 58 is an electrical connector 106. The electrical connectors 106 each have a wire 108 which passes through the tube 76 to connect with the transmission line 92. The electrical connectors 106 are of the conventional coaxial type and may be connected to a signal source such as an antenna at one end and to a signal processor, such as an amplifier, at the other end.

The holes 98 in the transmission line 92 shown in FIG. 6 are now filled with a pin 110 of a coupling mechanism and attached with solder 112 to the transmission line 92. The pins 110 pass through the passageways 66 shown in FIG. 5 in order to couple the signal from the transmission line 92 into the cavities 34A–34H when the filter cover 58 is placed over the filter body 20. Inside the threaded shaft 68 of FIG. 5 are adjustable capacitors 114 in FIG. 8. The adjustable capacitor 114 can be tuned from the outside or top surface 64 of the housing cover 58 so that when the cover 58 is in place over the filter body 20, it is not necessary to have physical access to the cavities 34A–34H to adjust the coupling to the cavities.

The design of the filter of the present invention has significant advantages over some prior art designs in which a transmission line is located outside of a housing containing cavities and resonators. Once the lid 100 is placed over the recess 60, the transmission line is sealed in a chamber formed by the recess 60. Likewise, the passageways 66 shown in FIG. 5 which connect the transmission line to the cavities 34A–34H are also sealed inside the chamber formed by the recess 60. Therefore, if it is necessary to evacuate or pressurize the cavities 34A–34H, the passageways 66 need not be sealed since the recess 60 is sealed. In addition, the shaft 72 can be used to pressurize and evacuate not only the chamber formed by the recess 60, but also the cavities 34A–34H via the passageways 66.

Figure 9:
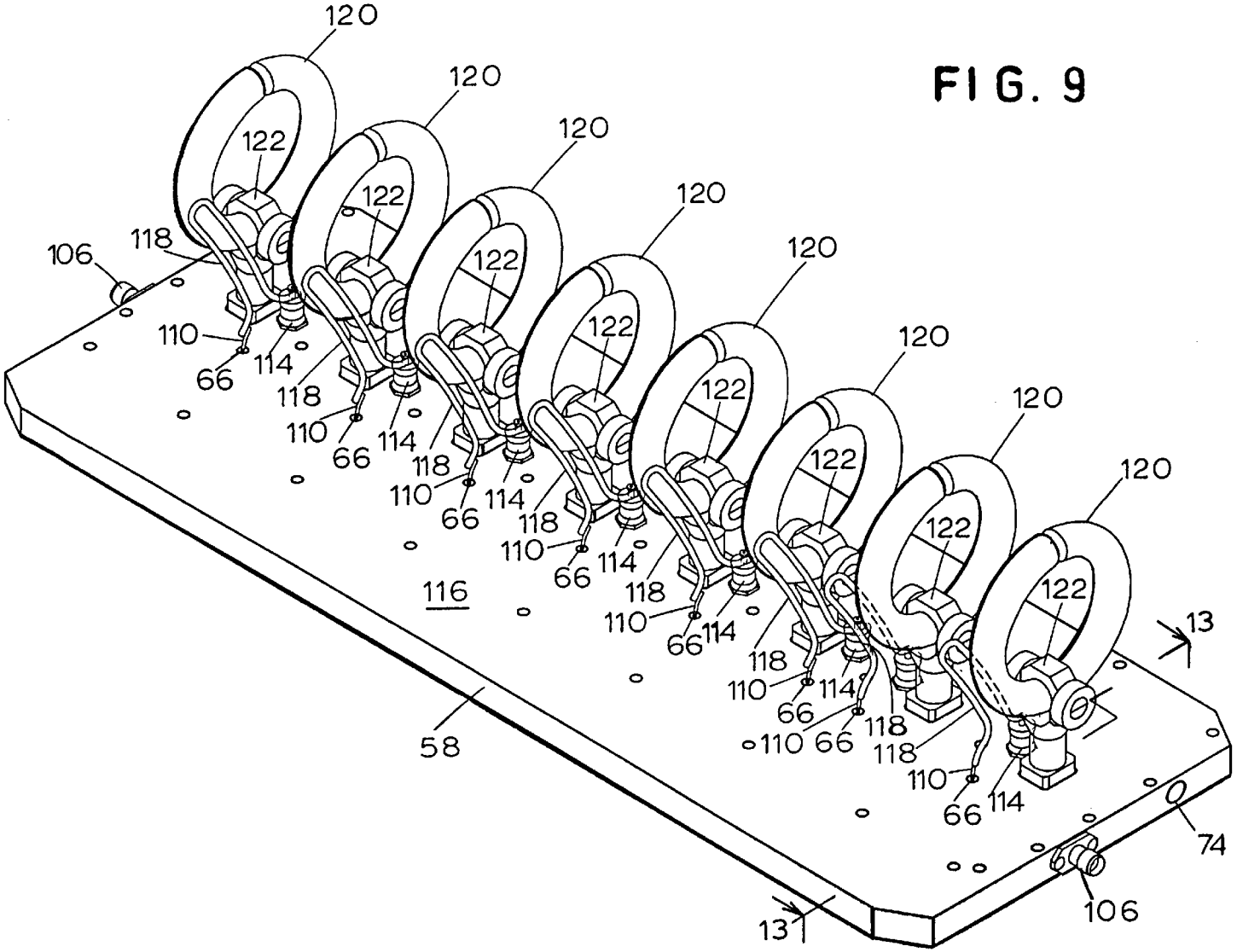
FIG. 9 is a perspective view of the bottom of the cover of FIG. 8 including resonators and coupling mechanism.

FIG. 9 is a bottom view of the housing cover 58 showing the bottom surface 116. The passageways 66 shown in FIG. 5 pass all the way through the bottom surface 116 and contain the pins 110. The pins 110 do not contact the sides of the passageways 66, so that the pins 110 are electrically insulated from the housing cover 58. Spacers (not depicted) may be placed around the pins 110 in the passageways 66 to insulate the pins. In such a case the passageways 66 may be sealed so the gases cannot pass from the recess 60 into the cavities 34A–34H. Each pin 110 is connected to an adjustable capacitor 114 by a coupling loop 118. Eight resonators 120 are attached to the housing cover 58 by mounting stands 122 adjacent the eight coupling loops 118. The housing cover 58 is designed to be placed over the filter body 20 as shown in FIG. 1 so that each pair of a resonator 120 and a coupling loop 118 fits into a cavity 34A–34H.

The design of the filter of the present invention with only two main housing portions (filter body 20 and housing cover 58) containing all the resonators and cavities, has significant advantages over other designs using multiple housing components. The housing cover 58 can be securely attached to the filter body 20 which is of a unitary construction so that there is little opportunity for dislocation of the resonators 120 or coupling loops 118. When the resonators 120 consist of or are coated with a superconductor, the filter will have to be cooled, which provides opportunities for movement of filter housing components due to differing coefficients of thermal expansion. Changes due to thermal expansion can be minimized by using the same material in the two components. By having only two major components, the design of the present filter minimizes such movement and provides for significant efficiencies in filter assembly.

Figure 10:
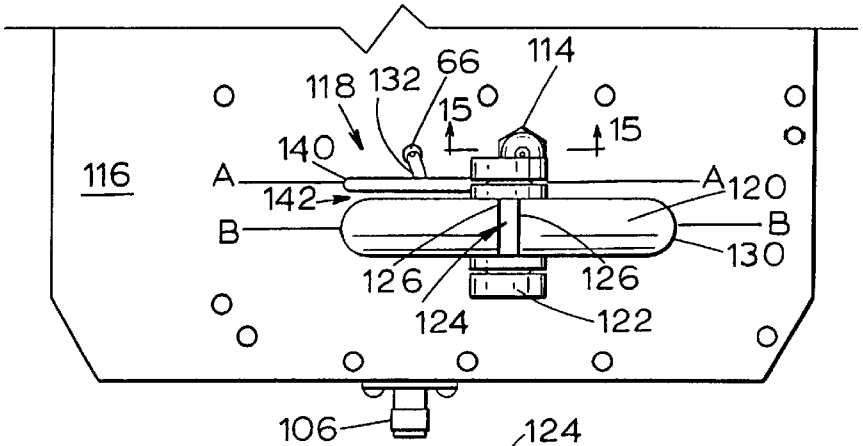
FIG. 10 is a top-plan view of a resonator and coupling mechanism of the present invention.
Figure 11:
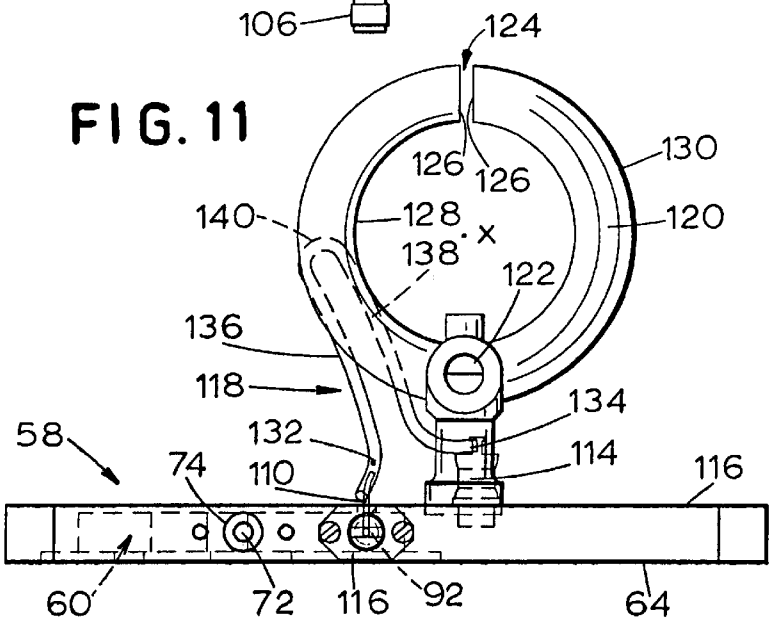
FIG. 11 is an end-elevational view of the resonator and coupling mechanism of FIG. 10.
Figure 12:
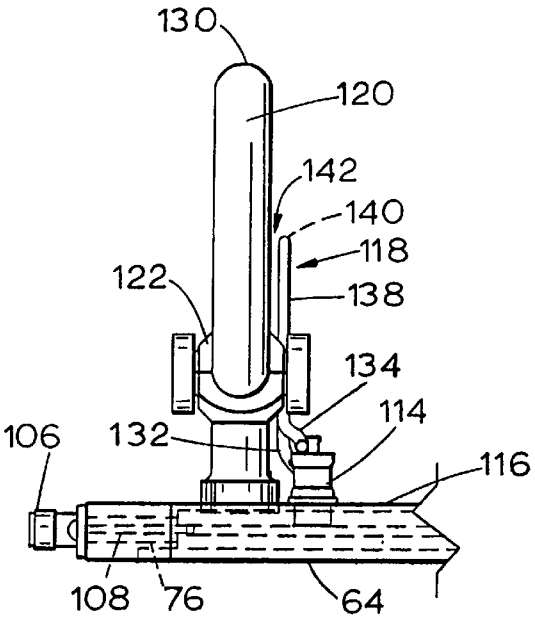
FIG. 12 is a side-elevational view of the resonator and coupling mechanism of FIG. 10.

FIGS. 10–12 show the relationship between the coupling loop 118 and the resonator 120. The resonator 120 has a gap 124 (FIGS. 10–11) so that the resonator has ends 126 (FIGS. 10–11). The resonator 120 is a toroid, symmetrical about the axis X (FIG. 11) except for the gap 124. The gap 124 is located away from the mounting stand 122 so that the mounting stand 122 covers the midpoint (traveling along the surface of the resonator) between the ends 126. The resonator 120 has a generally circular inner edge 128 and a generally circular outer edge 130, as best seen in FIG. 11.

The coupling loop 118 has a first end 132 connected to the pin 110 (FIG. 11) and a second end 134 connected to the top of adjustable capacitor 114. The pin 110, the coupling loop 118 and the top of the adjustable capacitor 114 are all made of metal, such as copper or brass, and are therefore connected to each other with solder. Attached to the first end 132 is a first arm 136 (FIG. 11) and attached to the second end 134 is a second arm 138 (FIGS. 11–12). The two arms 136 and 138 are connected to each other by a U-shaped portion 140. The first arm 136 is generally parallel to the second arm 138. The first end 132 and second end 134, however, are not parallel to each other but instead curve away from each other as they are directed to the pin 110 and the adjustable capacitor 114, respectively.

The coupling loop 118 is shaped and positioned such that the second arm 138 extends from past the outer edge 130 of the resonator 120 toward the inner edge 128 along a path which is generally tangent to the inner edge 128 (FIG. 11). The first arm 136 is generally tangent to the outer edge 130 of the resonator 120. When the resonator 120 is used as a halfwave resonator, its electric fields will be at its midpoint near the mounting stand 122. It is desirable to have the adjustable capacitor 114 near the midpoint and thus the second end 134 of the coupling loop 118 is adjacent the midpoint of the resonator 120.

The first arm 136 and second arm 138 of the coupling loop 118 lie generally in a plane A (FIG. 10). The curve of the resonator 120 similarly lies generally in a plane B which is perpendicular to the axis X of the resonator. The plane A is generally parallel to the plane B so that a uniform gap 142 is present between the resonator 120 and the coupling loop 118.

Figure 13:
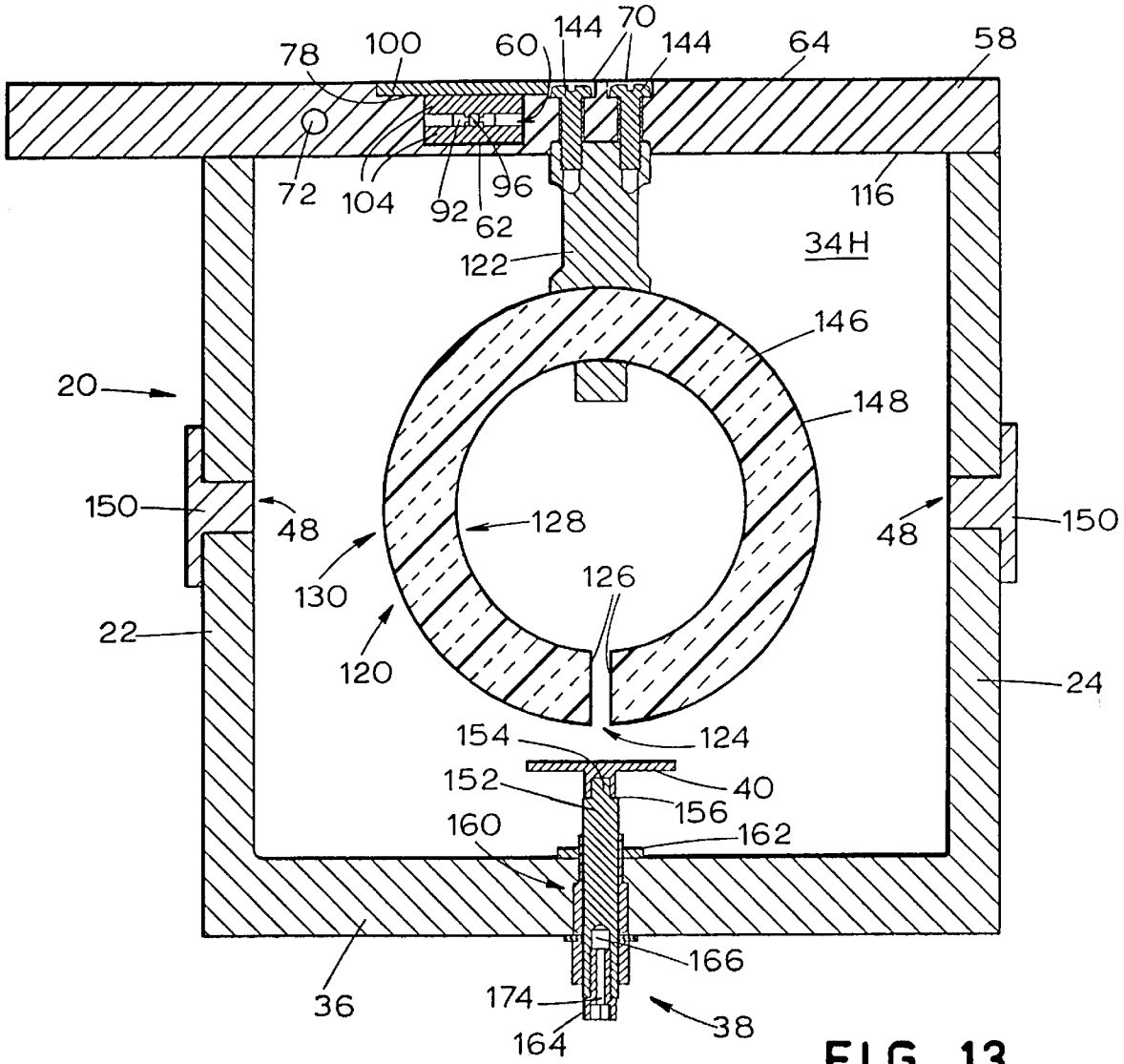
FIG. 13 is a cross-sectional view of the housing body and attached cover taken along the lines 13—13 of FIG. 8 and FIG. 9.

Referring now to FIG. 13, the housing cover 58 is shown in place over the filter body 20 in order to enclose the resonator 120 inside the cavity 34H. Two screws 144 have been inserted into mounting bores 70 to attach the mounting stand 122 to the bottom surface 116 of the housing cover 58. The resonator 120 is thereby held in a fixed position in the cavity 34H. Although many of the features of the present invention are useful with a variety of resonator types, the resonator 120 is a superconducting resonator. The resonator 120 includes a substrate 146 coated with a film of superconductor 148. For instance, the substrate may be made of alumina and the superconductor may be a thick film of yttrium barium cupric oxide. The passageways 48 on the front wall 22 and the back wall 24 have been sealed with plugs 150. It may be desirable to place small passageways through the plugs 150 so that vacuum applied around the filter, for instance in an evacuated cryo-refrigerator, will remove all gases from the cavities 34A–34H.

FIG. 13 also shows the relationship of various structures around the transmission line 92. The transmission line is held in place by the two portions of the spacer 104. The spacer 104 prevents the transmission line from moving up and down because the spacer is held firmly between the back wall 62 of the recess 60 and the lid 100. Small ridges (unnumbered) on the spacer 104 adjacent the notched areas 96 prevent the transmission line 92 from moving laterally.

Figure 14:
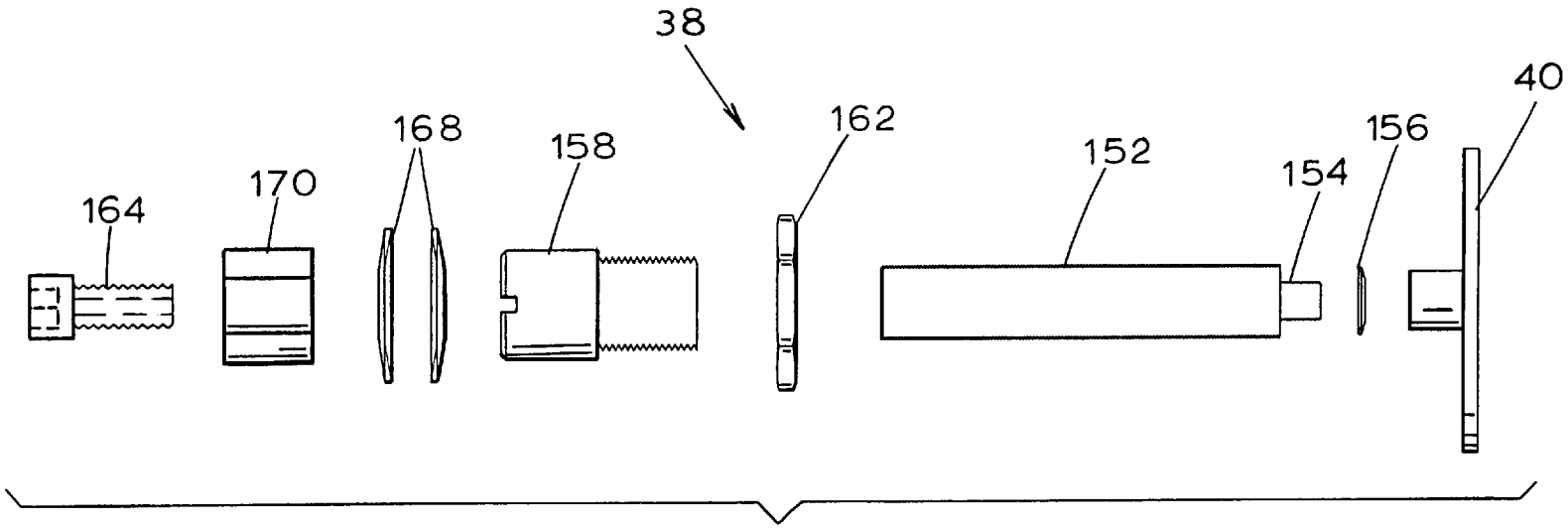
FIG. 14 is an exploded-plan view of a tuner of the present invention.

FIG. 13 along with FIG. 14 show details of the tuner 38 having the tuning disc 40 connected to a tuner body 152 by threads on the interior of the tuning disc 40 and on the exterior of a tip 154 of the tuner body 152. A belleville or locking type washer 156 is placed between the tuning disc 40 and the tuner body 152. A tuner bushing 158 (FIG. 14) is inserted into a passageway 160 (FIG. 13) in the bottom wall 36 of the filter body 20. The tuner bushing 158 is held in place in the bottom wall 36 by a tuner bushing locknut 162. The tuner body 152 is inserted into the tuner bushing 158 which engage each other by threads on the exterior of the tuner body 152 and on the interior of the tuner bushing 158. The tuner body 152 is rotated with respect to the tuner bushing 158 by use of a caphead screw 164. The caphead screw 164 is inserted into a recess 166 in the tuner body 152 (FIG. 13) and held in place by threads on the outside of the caphead screw 164 and threads in the recess 166 of the tuner body 152. The caphead screw 164 may be hexagonal to accept an allen wrench.

When the caphead screw 164 is rotated, the tuner body 152 rotates, thereby moving the tuning disc 40 closer to or farther from the gap 124 of the resonator 120. The tuning disc 40 is made of a conductor, such as brass coated with silver, and therefore impacts the magnetic and electric fields around the resonator 120. The resonator 120 and cavity 34 are thereby tuned to resonate at the desired frequency. Once the tuning disc 40 has been properly positioned, the tuner body is locked in place using two washers 168 (FIG. 14) and a locknut 170. The adjustment and use of the tuner 138 may often occur at temperatures significantly below the freezing temperature of water, particularly when used in connection with superconducting resonators. It is possible for moisture to be trapped in the recess 166 behind the caphead screw 164 and affect vacuum in the filter. Tuning is often sensitive to slight changes in positioning, so it is imperative that little moisture be retained in the recess 166 to prevent significant performance degradation. Moisture may also freeze and prohibit rotation of the tuner body 152 during tuning. In order to eliminate moisture, a passageway 174 (FIG. 13) is placed in the caphead screw 164 to enable better outgassing and to preserve better vacuum. Vents (not depicted) may also be placed from the outside of the filter body 20 or the housing cover 58 to permit outgassing in any of the openings or passageways which have bolts or screws inserted in them. The vents would connect the bottom of openings, such as the openings 44, with the environment outside the filter housing.

Having the tuner body 152 and the caphead screw 164 made of separate components is desirable because it allows greater flexibility in sizing of the tuner body 152. In many instances, the distance from the resonator 120 to the tuning disc 40 will vary significantly in each of the cavities 34. If only one size tuner body is used, it would have to be relatively long to accommodate the desired short distance between some tuning discs 40 and resonators 120. In cavities where the distance should be relatively large, the tuner body would then stick out significantly from the bottom wall 36 and might interfere with other structures such as a cryo-refrigerator cooling the filter. Cutting excess tuner body off after tuning is not desirable because it inhibits later adjustment and would likely induce movement of the tuning disc 40 during the cutting operation. The design of the tuner 38 of the present invention, however, allows for use of many sizes of tuner bodies 152, which can be easily substituted for one another simply by adding the cap screw 164 with the passageway 174. Thus the passageway 174 through the cap head screw 164 permits one to use a tuner design which is adaptable to a wide variety of tuner disc positions while still performing properly at cryogenic temperatures.

Figure 15:
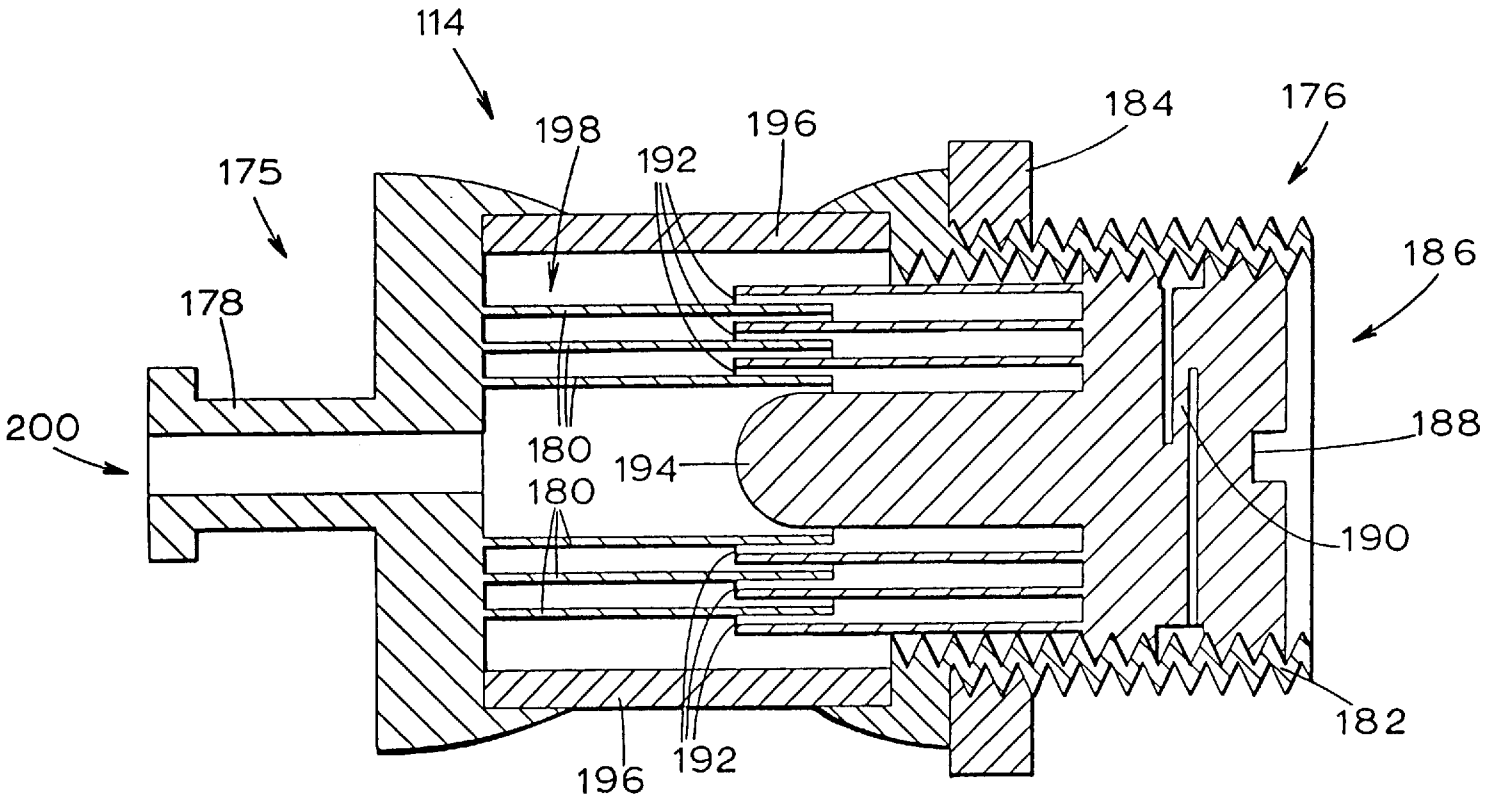
FIG. 15 is a cross-sectional view of an adjustable capacitor taken along the lines 15—15 of FIG. 10.

Referring now to FIG. 15, the adjustable capacitor 114 has a first end 175 and a second end 176. The first end 175 is made of an electrically conductive material and has a neck 178 which can be used to attach the capacitor to a signal source. The first end 175 has a number of cylindrical plates 180 in electrical contact with it. The second end 176 is made of an electrically conductive material and has a sleeve 182 which is threaded on its inside and on its outside. The outer threads are designed to be inserted into the shaft 68 of the housing cover 58 (FIG. 5) until seated against a flange 184 on the second end 176. Located in the sleeve 182 is an adjuster 186 which has a screw head 188. The adjuster 186 is designed to be rotated by use of the screw head 188 so that the threads on the outside of the adjuster mate with the threads on the inside of the sleeve 182. The adjuster has a spring 190 which aids in locking the adjuster in place. Attached to the adjuster 186 are several cylindrical plates 192 and a central peg 194 (which could also be a plate) which are adjacent to but not in contact with the plates 180. The first end 175 is separated from the second end 176 by a cylindrical insulated housing 196. The housing 196 defines a cavity 198 which contains the plates 180, the plates 192 and the peg 194. The plate 192 and peg 194 are metallic, as is the adjuster 186 and the sleeve 182. The housing cover 58 to which the sleeve 182 is attached is also metallic and usually connected to an electrical ground so that the plates 192 and peg 194 are grounded.

When the adjuster 186 is rotated, the plates 192 and peg 194 move with respect to the plates 180 in order to increase the surface area of the adjuster 186 which is adjacent the plates 180 to change the capacitance of the capacitor. When the adjuster 186 is moved, the size of the cavity 198 is changed so that gases inside the cavity 198 are forced out. Normally such gasses are forced out between the outer threads of the adjuster 186 and the inner threads of the sleeve 182, but some gas usually remains in the cavity 198. Any gas remaining in the cavity 198 may contain moisture which can disrupt the functioning of the capacitor if the capacitor is cooled below 0° C. when, for instance, superconducting components are used in connection with a capacitor. Moisture in the cavity 198 can interfere with the position of the adjuster 186 or may form ice bridges between the plates 180 and the plates 192.

In order to reduce the moisture problem, a passageway 200 is placed through the first end 174 into the cavity 198. If the filter of the present invention is submerged in liquid nitrogen for cooling purposes, it is desirable to fill the cavities 34A–34H with an inert gas such as helium to prevent the liquid nitrogen from entering the cavities. The provision of the passageway 200 permits the helium to enter the cavity 198 of the capacitor 114 and force out any moisture. The moisture may pass out of the passageway 200 or between the threads of the adjuster 186 and the inner threads of the sleeve 182. The cavity 198 may also be evacuated for cooling, in which case the passageway 200 will serve as an egress for any moisture in the cavity 198. An adjustable capacitor as shown in FIG. 15 without the passageway 200 can be purchased from Johnson Manufacturing Corporation of Boonton, N.J., Model No. 5402PC.

The foregoing detailed description has been given for clearness of understanding, and no unnecessary limitations should be understood therefrom, as modifications would be obvious to those skilled in the art.

We claim:

1. An electromagnetic filter comprising:

a housing having a base and a cover wherein the base and the cover define a plurality of cavities;

a plurality of resonators mounted on the cover, wherein each resonator is located in a corresponding one of the plurality of cavities;

a transmission line having an input and an output wherein the transmission line is contained in, and electrically insulated from any conductor of, the cover; and a plurality of coupling mechanisms mounted on the cover wherein each coupling mechanism is electrically connected to the transmission line and located adjacent a corresponding resonator.

2. An electromagnetic filter comprising:

a housing having a plurality of open cavities;

a cover having a first side and a second side;

means for attaching the cover to the housing so that the first side of the cover faces and closes the cavities;

a plurality of resonators attached to the first side of the cover wherein the plurality of resonators are respectively located in the cavities when the cover is attached to the housing;

a transmission line mounted inside the cover; and a plurality of coupling mechanisms located on the first side of the cover, each coupling mechanism coupled to the transmission line and located adjacent to a corresponding one of the plurality of the resonators.

3. The filter of claim 2 wherein the filter is located in an atmosphere having a temperature at or below 92° K.

4. The filter of claim 2 wherein each resonator comprises a respective superconductor.

5. The filter of claim 2 wherein the plurality of cavities contain substantially no gases.

6. The filter of claim 2, wherein the coupling mechanisms are adjustable from the second side of the cover.

7. An electromagnetic filter comprising:

a housing containing a plurality of resonators;

a transmission line having an input and an output; and a plurality of coupling mechanisms, each coupling mechanism electrically connected to the transmission line and located adjacent to a corresponding one of the plurality of the resonators;

wherein the housing comprises a body and a removable cover;

the cover comprises a main portion and a lid;

the main portion and the lid define a chamber;

the transmission line is located in the chamber; and the main portion of the cover has passageways through which conductors pass to connect the transmission line to the coupling mechanism.

8. The electromagnetic filter of claim 7 wherein the plurality of resonators are attached to the cover.

* * * * *